US009739287B2

(12) United States Patent
Cocks et al.

(10) Patent No.: US 9,739,287 B2
(45) Date of Patent: Aug. 22, 2017

(54) FAN AND MOTOR ASSEMBLY AND METHOD OF ASSEMBLING

(71) Applicant: Regal Beloit America, Inc., Beloit, WI (US)

(72) Inventors: Rachele Barbara Cocks, Columbia City, IN (US); Matthew James Kleist, Rothschild, WI (US); Zachary Joseph Stauffer, Fort Wayne, IN (US)

(73) Assignee: Regal Beloit America, Inc., Beloit, WI (US)

( * ) Notice: Subject to any disclaimer, the term of this patent is extended or adjusted under 35 U.S.C. 154(b) by 1038 days.

(21) Appl. No.: 13/747,122

(22) Filed: Jan. 22, 2013

(65) Prior Publication Data

US 2014/0205450 A1 Jul. 24, 2014

(51) Int. Cl.

| | |
|---|---|
| ***F04D 29/64*** | (2006.01) |
| ***F04D 17/16*** | (2006.01) |
| ***F04D 25/06*** | (2006.01) |
| ***F04D 29/42*** | (2006.01) |

(Continued)

(52) U.S. Cl.

CPC ..... *F04D 29/644* (2013.01); *F04D 17/16* (2013.01); *F04D 25/0606* (2013.01); *F04D 29/4213* (2013.01); *F04D 29/441* (2013.01); *F04D 29/626* (2013.01); *F05D 2250/51* (2013.01); *Y10T 29/49245* (2015.01)

(58) Field of Classification Search

CPC .... F04D 29/644; F04D 17/16; F04D 25/0606; F04D 29/4213; F04D 29/441; F04D 29/626

See application file for complete search history.

(56) References Cited

U.S. PATENT DOCUMENTS 2,142,307 A * 1/1939 De Mey ..... F04D 29/646 415/119
3,775,029 A * 11/1973 Ranz ..... H02K 5/00 392/360
4,043,708 A 8/1977 Greenfield (Continued)

FOREIGN PATENT DOCUMENTS

EP 0208742 A1 1/1987
EP 0963556 A2 12/1999

(Continued)

OTHER PUBLICATIONS

Flight Physics: Essentials of Aeronautical Disciplines and Technology, with Historical Notes by Egbert Torenbeek et al., Springer Science & Business Media, Jul. 6, 2009. pp. 101-102.*

*Primary Examiner* — Justin Seabe
(74) *Attorney, Agent, or Firm* — Armstong Teasdale LLP

(57) ABSTRACT

A motor assembly is provided that includes a fan housing having an air inlet and an air outlet, and a motor coupled to the fan housing and positioned within the air inlet. The motor includes a first end, a second end, and a shaft. The motor assembly further includes a fan coupled to the shaft proximate the motor second end. The motor first end includes a contoured surface having a stagnation point and a plurality of points along the contoured surface downstream of the stagnation point. Each point of the plurality of points has a coefficient of pressure less than 1, and the contoured surface is configured to direct air around the motor and to reduce airflow restriction and flow disturbance within the fan housing.

15 Claims, 6 Drawing Sheets

(51) Int. Cl.
*F04D 29/44* (2006.01)
*F04D 29/62* (2006.01)

(56) References Cited

U.S. PATENT DOCUMENTS

| | | | | | |
|---|---|---|---|---|---|
| 4,200,257 | A * | 4/1980 | Litch, III | F04D 29/282 | 248/604 |
| 4,593,638 | A | 6/1986 | Cochran et al. | | |
| 4,657,483 | A * | 4/1987 | Bede | F04D 29/545 | 415/210.1 |
| 5,174,048 | A * | 12/1992 | Shero | F26B 21/001 | 34/444 |
| 6,290,174 | B1 | 9/2001 | Gioia | | |
| 6,499,954 | B1 * | 12/2002 | Adonakis | F04D 29/30 | 416/185 |
| 6,638,037 | B2 | 10/2003 | Grant | | |
| 6,901,814 | B2 | 6/2005 | Vozhdaev et al. | | |
| 7,044,720 | B1 | 5/2006 | Yamamoto et al. | | |
| 7,785,075 | B2 | 8/2010 | Botrel et al. | | |
| 8,057,167 | B2 | 11/2011 | Suzuki et al. | | |

FOREIGN PATENT DOCUMENTS

| | | | | |
|---|---|---|---|---|
| EP | 1468908 | A1 | 10/2004 | |
| EP | 1847683 | A1 | 10/2007 | |
| GB | 2074244 | A * | 10/1981 | F02C 7/04 |
| WO | 8604036 | A1 | 7/1986 | |
| WO | 9833071 | A2 | 7/1998 | |

* cited by examiner

FAN AND MOTOR ASSEMBLY AND METHOD OF ASSEMBLING

BACKGROUND

The field of the disclosure relates generally to motors and, more specifically, to fan motor assemblies for use in forced air or air circulating systems.

Many known residential and commercial forced air, heating and air conditioning systems require air propulsion units. In addition to providing movement of air for heating and cooling systems, air propulsion units are often used in combination with condenser units or to supplement other heat transfer operations. Some known air propulsion units are motor driven fans. These fans may be, for example, a blower wheel type or a multi-bladed type. However, some known motors and/or their mounting components restrict entering and exiting air and produce aerodynamic losses that negatively affect the overall performance of the fan.

BRIEF DESCRIPTION

In one aspect, a motor assembly is provided. The motor assembly includes a fan housing having an air inlet and an air outlet, and a motor coupled to the fan housing and positioned within the air inlet. The motor includes a first end, a second end, and a shaft. The motor assembly further includes a fan coupled to the shaft proximate the motor second end. The motor first end includes a contoured surface having a stagnation point and a plurality of points along the contoured surface downstream of the stagnation point. Each point of the plurality of points has a coefficient of pressure less than 1, and the contoured surface is configured to direct air around the motor and to reduce airflow restriction and flow disturbance within the fan housing.

In another aspect, a motor assembly is provided. The motor assembly includes a fan housing having an air inlet and an air outlet, and a motor positioned within the air inlet. The motor includes a first end, a second end, and a shaft. The motor assembly further includes a fan coupled to the shaft, and at least one mounting arm coupled to the motor and the fan housing. The at least one mounting arm includes a streamlined body having a first end having a stagnation point, a second end, and a plurality of points along a surface of the streamlined body downstream of the stagnation point. Each point of the plurality of points has a coefficient of pressure less than 1, and the streamlined body is configured to direct air around the at least one mounting arm and to reduce airflow restriction and flow disturbance within the fan housing.

In yet another aspect, a motor assembly is provided. The motor assembly includes a fan housing having an air inlet and an air outlet, and a motor positioned within the air inlet. The motor includes a first end, a second end, and a shaft. The motor assembly further includes a fan coupled to the shaft proximate the motor second end, and at least one mounting arm coupled to the motor and the fan housing. The at least one mounting arm includes a streamlined body having a first end having a first stagnation point, a second end, and a first plurality of points along a surface of the streamlined body downstream of the first stagnation point. Each point of the first plurality of points has a coefficient of pressure less than 1, and the streamlined body is configured to direct air around the at least one mounting arm. The motor first end includes a contoured surface having a second stagnation point and a second plurality of points along the contoured surface downstream of the second stagnation point. Each point of the second plurality of points has a coefficient of pressure less than 1, and the contoured surface is configured to direct air around the motor. The streamlined body and the contoured surface are configured to reduce airflow restriction and flow disturbance within the fan housing.

In yet another aspect, a method of assembling a motor assembly is provided. The method includes providing a fan housing having an air inlet and an air outlet, and positioning a motor within the air inlet, the motor having a first end, a second end, a shaft, and at least one mounting arm. The method further includes coupling the at least one mounting arm to the fan housing, coupling a fan to the shaft proximate the motor second end, and providing a streamlined body on the mounting arm. The streamlined body includes a first end having a first stagnation point, a second end, and a first plurality of points along a surface of the streamlined body downstream of the first stagnation point. Each point of the first plurality of points has a coefficient of pressure less than 1, and the streamlined body is configured to direct air around the at least one mounting arm and to reduce airflow restriction and flow disturbance within the fan housing. The method further includes providing a contoured surface on the motor first end, the contoured surface having a second stagnation point and a second plurality of points along the contoured surface downstream of the second stagnation point. Each point of the second plurality of points has a coefficient of pressure less than 1, and the contoured surface is configured to direct air around the motor to reduce airflow restriction and flow disturbance within the fan housing.

DETAILED DESCRIPTION

The present disclosure provides an exemplary fan and motor assembly with an aerodynamic structural design that improves air flow over the assembly, air flow entering the fan, and downstream of the fan. More specifically, the exemplary fan and motor assembly includes a contoured motor housing, contoured mounting brackets, and an inlet guide vane that each reduce airflow restriction and downstream disturbances in the airflow, which results in increased efficiency and a more favorable and laminar airflow into the fan, thereby improving fan and system efficiency.

Figure 1:
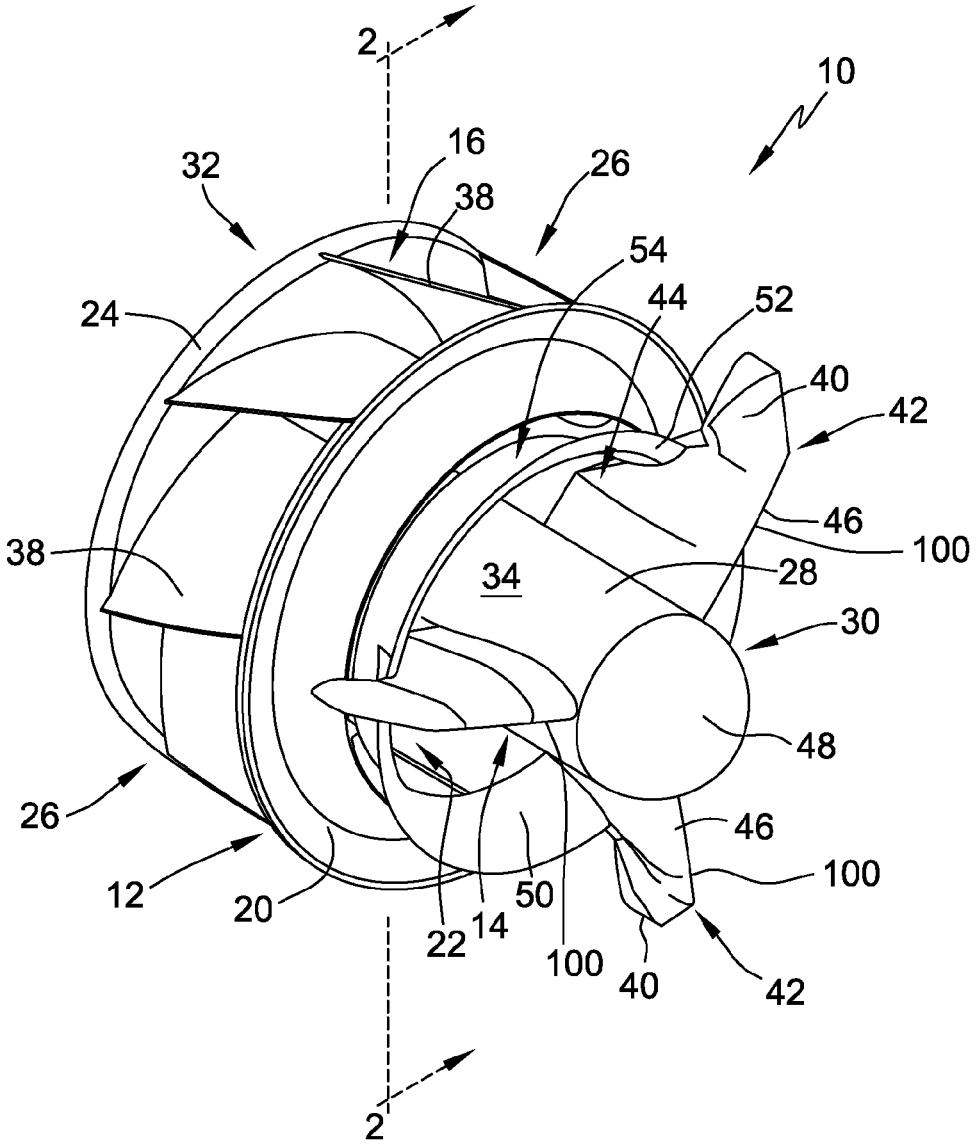
FIG. 1 is a perspective view of an exemplary fan assembly.
Figure 2:
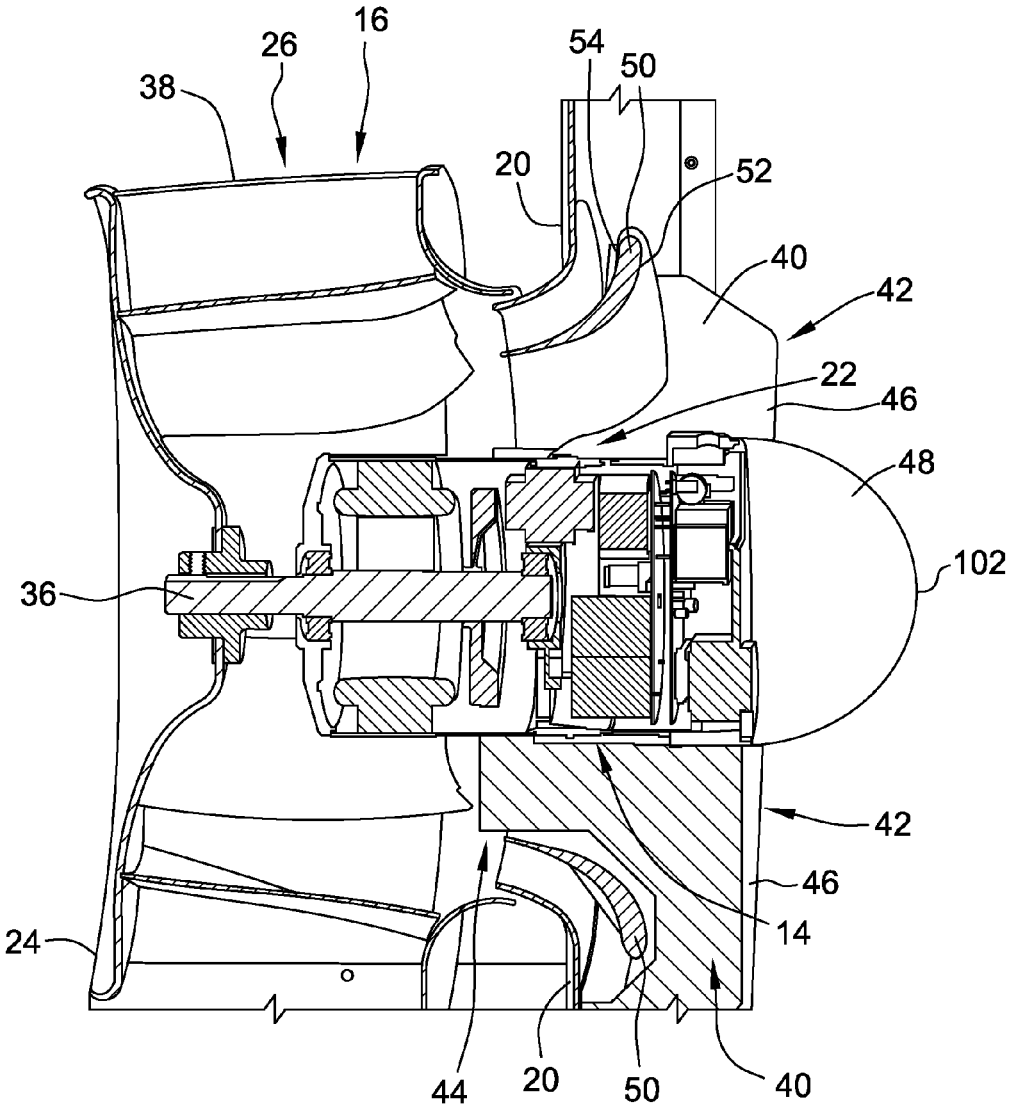
FIG. 2 is a cross-sectional view of the fan assembly of FIG. 1 taken along line 2-2.
Figure 3:
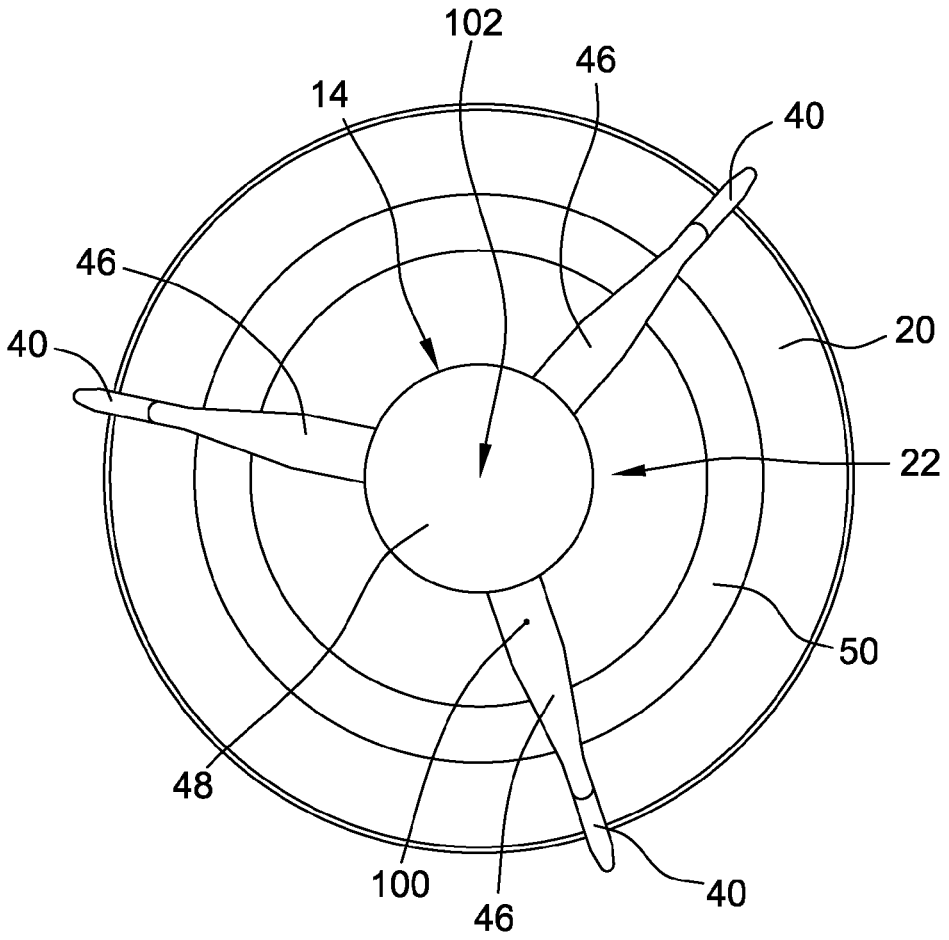
FIG. 3 is a front view of the fan assembly of FIG. 1.

FIGS. 1-3 illustrate an exemplary embodiment of a fan and motor assembly 10 including a fan housing 12, a motor 14, and a fan 16. Fan housing 12 includes a first end 20 and a second end 24. In the exemplary embodiment, fan housing 12 is a centrifugal fan housing with an air inlet 22 defined by first end 20, and an air outlet 26 defined circumferentially between first and second ends 20 and 24. Alternatively, second end 24 includes air outlet 26 therein. Motor 14 is positioned within air inlet 22 upstream of fan 16 and includes a housing 28 having a first end 30, a second end 32, and a sidewall 34 extending from first end 30 to second end 32. In the exemplary embodiment, housing 28 is generally cylindrical and is positioned concentrically with fan housing 12 in air inlet 22. Alternatively, housing 28 may be any suitable shape that enables assembly 10 to function as described herein. Motor 14 also includes a shaft 36 extending at least partially therethrough and that is operable for rotational movement. Fan 16 is coupled to shaft 36 and includes a plurality of blades 38 that produce a flow of air for a system such as a residential HVAC. In the exemplary embodiment, fan 16 is a backward inclined centrifugal fan and is coupled to shaft 36 proximate second end 32 downstream of motor 14. Alternatively, fan 16 may have any suitable shape that enables assembly 10 to function as described herein.

In the exemplary embodiment, motor 14 is coupled to fan housing 12 by mounting arms 40, which extend across air inlet 22 between motor housing 28 and fan housing 12. Mounting arms 40 each include a leading first end 42 and a second end 44. While three mounting arms 40 are depicted in the drawings, assembly 10 may have any number of mounting arms 40 (e.g. four, five, etc.). In an alternative embodiment, mounting arms 40 may be angled relative to fan housing 12 and/or motor 14. In some known systems, mounting arms have shapes or surfaces with geometries having high fluid flow restriction (e.g. flat surfaces), which may cause undue airflow restriction and downstream airflow disturbances. As such, the associated drag from the separation of flow as it moves around an object creates a low pressure gradient or low pressure section behind the object that causes a flow disturbance. This produces turbulence and airflow restriction at the inlet of the fan and/or downstream of the fan and causes the blades to be less efficient, which reduces fan efficiency and therefore system performance.

In the exemplary embodiment, however, mounting arm first end 42 includes a streamlined body 46 facing oncoming airflow within air inlet 22. In the exemplary embodiment, streamlined body 46 is integral with mounting arm 40. Alternatively, streamlined body 46 may be a separate component or cap coupled to mounting arm 38. In the exemplary embodiment, streamlined body 46 has a surface shape with a low coefficient of pressure (e.g. airfoil, elliptical shape, hemispherical shape). The coefficient of pressure is a dimensionless number which describes relative pressures relating the pressure at the surface of a body to the freestream pressure.

Figure 4:
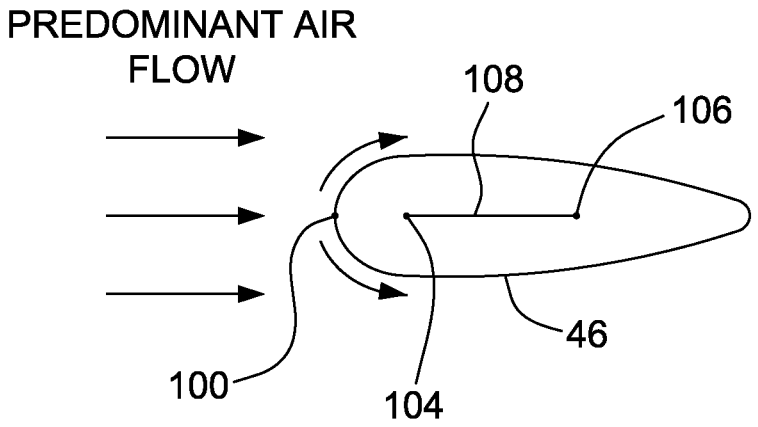
FIG. 4 is a cross-sectional view of a mounting arm of the fan assembly shown in FIG. 1.

As shown in FIG. 4, body 46 includes a stagnation point or region 100 along leading end 42 that is the first point or region where airflow contacts streamlined body 46. At stagnation point 100, the coefficient of pressure (Cp) is defined as equal to 1. In the example embodiment, mounting arms 40 are contoured such that each point along a surface of streamlined body 46 downstream of stagnation point 100 has a Cp less than 1. More particularly, each point along streamlined body 46 downstream of stagnation point 100 has a Cp less than zero. In an alternate embodiment, each point along a surface of streamlined body 46 downstream of stagnation point 100 has a Cp less than 0.5. In yet another embodiment, each point along a surface of streamlined body 46 downstream of stagnation point 100 has a Cp less than 0.1. In one embodiment, the Cp values along the surface of streamlined body 46 decrease when moving downstream of stagnation point 100. In the exemplary embodiment, the Cp along streamlined body 46 steadily decreases moving downstream from stagnation point 100 to second end 44. Streamlined body 46 is axis-symmetric and includes a first focus 104 and a second focus 106. A line 108 between focus 104 and focus 106 is substantially aligned with the predominant air flow direction. In the example embodiment, line 108 is angled between 5° and −5° of the predominant air flow into assembly 10. Streamlined body 46 is shaped to direct air around mounting arm 40 with reduced airflow restriction and to create a laminar airflow into blades 38. In this way, streamlined body 46 facilitates reducing airflow disturbance within fan housing 12 and improves fan and system efficiency.

In the exemplary embodiment, motor 14 is positioned within fan housing 12 upstream of fan 16 such that motor first end 30 is positioned within the path of air flowing through air inlet 22. In some known systems, motors within housing inlets have end surfaces with high drag coefficients (e.g. flat surfaces), which may cause airflow restriction and flow disturbance. In the exemplary embodiment, however, motor first end 30 includes a contoured surface 48 that has a surface shape with a low coefficient of pressure (e.g. hemispherical, elliptical or ogival).

Figure 5:
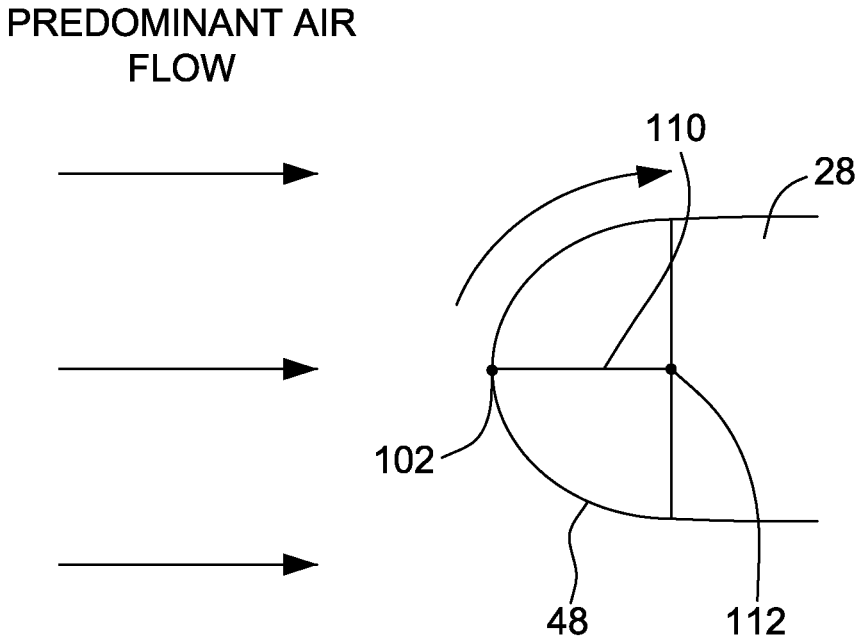
FIG. 5 is a cross-sectional view of a contoured surface of the fan assembly shown in FIG. 1.

As shown in FIG. 5, contoured surface 48 is integral with motor housing 28. Alternatively, contoured surface 48 may be a separate component or cap coupled to motor housing 28. Contoured surface 48 includes a stagnation point or region 102 that is the most upstream point or region of surface 48 where airflow first contacts the surface. At stagnation point 102, the coefficient of pressure is equal to 1. In the example embodiment, surface 48 is contoured such that each point downstream of stagnation point 102 has a Cp less than 1. More particularly, each point along contoured surface 48 downstream of stagnation point 102 has a Cp less than zero. In an alternate embodiment, each point along contoured surface 48 downstream of stagnation point 102 has a Cp less than 0.5. In yet another embodiment, each point along contoured surface 48 downstream of stagnation point 102 has a Cp less than 0.1. Contoured surface 48 is axis-symmetric and a line 110 between stagnation point 102 and a centerpoint 112 of motor 14 is substantially aligned with the predominant air flow direction. In the example embodiment, line 110 is angled between 5° and −5° of the predominant air flow into assembly 10. Contoured surface 48 is shaped to direct air around motor 14 with reduced airflow restriction and to create a laminar airflow into blades 38. In this way, contoured surface 48 facilitates reducing airflow disturbance within fan housing 12 and improves fan and system efficiency.

In the exemplary embodiment, fan housing 12 includes an inlet guide vane 50 that includes curved inner and outer surfaces 52 and 54, respectively. Inlet guide vane 50 is coupled to mounting arms 40 and is positioned concentrically within air inlet 22 between fan housing 12 and motor 14. In some known systems, air surrounding the fan housing is pulled into the air inlet at different angles, particularly at the edges of the air inlet (e.g. air being pulled into the inlet perpendicularly to the axis of the rotating shaft). The differently angled airflows entering the inlet cause disturbances in the airflow, which reduces fan efficiency. In the exemplary embodiment, however, inlet guide vane 50 is contoured such that air entering inlet 22 at different angles is re-directed in an axial direction along motor 14, reducing flow disturbance and improving fan efficiency. The curvature of inlet guide vane 50 also increases airflow attachment along surfaces 52 and 54, which accelerates and directs airflow into fan 16 and improves fan efficiency. Although a single inlet guide vane 50 is described, any number of concentric inlet guide vanes 50 may be used in assembly 10.

Figure 6:
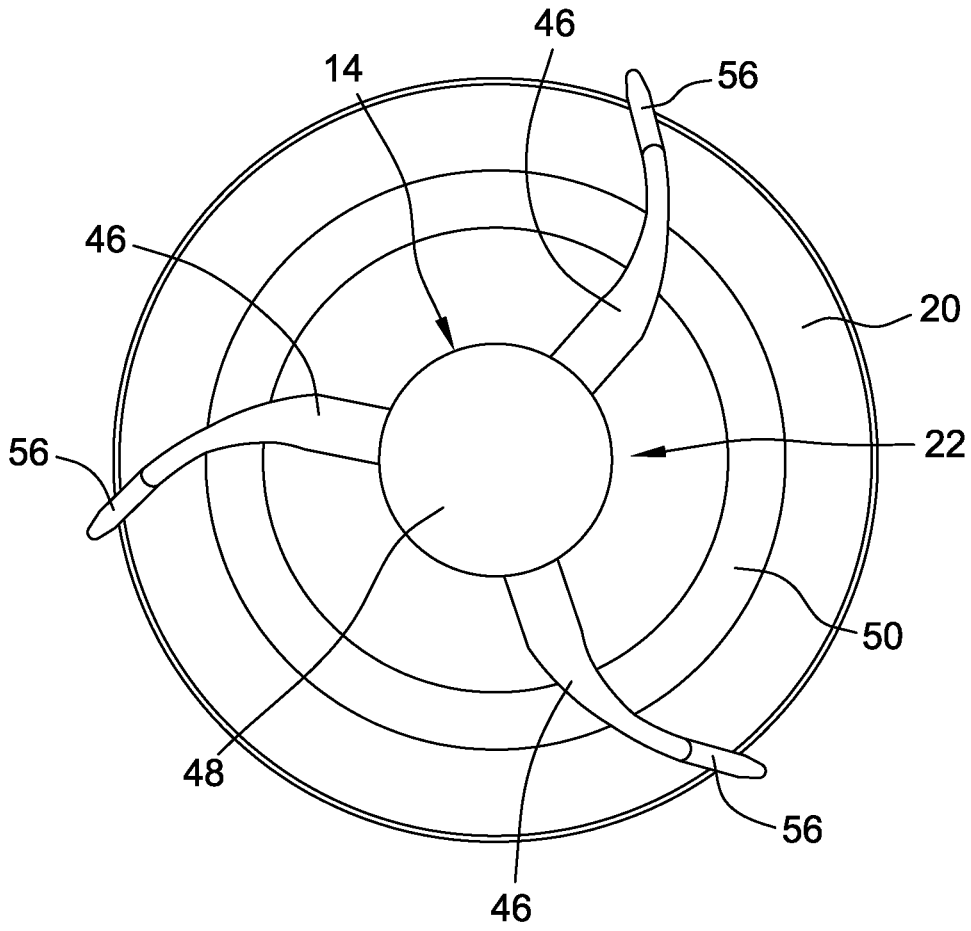
FIG. 6 is a front view of the fan assembly of FIG. 1 with an alternate mounting arm arrangement.

FIG. 6 illustrates an exemplary fan and motor assembly 11 that is similar to fan and motor assembly 10, except fan and motor assembly 11 includes curved mounting arms 56. In the exemplary embodiment, mounting arms 56 are curved in the axial direction as they extend radially from motor 14. As such, curved mounting arms 56 are contoured to pre-turn airflow through air inlet 22. Curved mounting arms 56 create a turning airflow upstream of fan 16 and direct the pre-turned airflow into fan 16, which increases fan efficiency. Curved mounting arms 56 include streamlined body 46 to direct air around mounting arms 56 with reduced airflow restriction, reducing airflow disturbance within fan housing 12 and improving efficiency of fan 16.

An exemplary method of assembly of fan and motor assemblies 10 and 11 is provided herein. The method includes providing a fan housing 12 having an air inlet 22 and an air outlet 26. A motor 14 is positioned within the air inlet 22. Motor 14 includes a motor housing 28 having a first end 30, a second end 32 and a sidewall 34 extending therebetween. Motor 14 also includes one or more mounting arms 40 and/or 56, and a shaft 36 is rotatably coupled to motor 14. The method includes coupling mounting arms 40 and/or 56 to fan housing 12 and coupling a fan 16 to shaft 36 proximate fan housing second end 24. A contoured surface 48 is provided on motor housing first end 30. Contoured surface 48 is configured to direct air around motor 14 and to reduce airflow restriction and flow disturbance within fan housing 12. A streamlined body 46 is provided on mounting arms 40 and/or 56, and streamlined body 46 directs air around mounting arm 40, 56 and reduces airflow restriction and flow disturbance within fan housing 12. The method includes coupling an inlet guide vane 50 to mounting arm 40 and/or 56 between fan housing 12 and motor 14. Guide vane 50 is curved and configured to create a low pressure gradient to pull airflow around guide vane 50 and to keep airflow attached along guide vane surfaces 52 and 54 to direct airflow into fan 16.

The methods and systems described herein provide a fan and motor assembly with surfaces acting as directional airflow vanes to improve overflow over the assembly and into the fan. The exemplary fan and motor assembly includes a contoured motor housing, contoured mounting brackets, and an inlet guide vane that each reduce drag and downstream disturbances in the airflow, which results in a more favorable and laminar airflow into the fan, thereby improving fan efficiency. Moreover, the benefits derived from the contoured surfaces are not additive and, as such, the combination of the contoured surfaces provides significantly greater air flow improvement over any single contoured surface alone. The exemplary embodiments described herein provide systems particularly well-suited for commercial and residential HVAC applications, with significantly improved airflow and efficiency.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A motor assembly comprising:

a fan housing comprising an air inlet and an air outlet;

a motor positioned within said air inlet, said motor comprising a first end, a second end, and a shaft;

at least one mounting arm coupled to said motor and said fan housing;

a fan coupled to said shaft proximate said motor second end; and an inlet guide vane coupled to said at least one mounting arm, said inlet guide vane positioned at least partially within said air inlet between said motor and said fan housing, said inlet guide vane comprising a curved inner surface opposite a curved outer surface, wherein said curved inner surface and said curved outer surface are configured to direct air into said air inlet;

wherein said at least one mounting arm comprises a streamlined body having a stagnation point and a plurality of points along said streamlined body downstream of said stagnation point, wherein each point of the plurality of points has a coefficient of pressure less than 0.5, said streamlined body further comprising a pair of opposing surfaces extending from said stagnation point and meeting at a second end, said streamlined body configured to direct air around said motor and to reduce airflow restriction and flow disturbance within said fan housing;

and wherein said at least one mounting arm is curved in the axial direction and is configured to turn airflow upstream of said fan.

2. The assembly of claim 1, wherein said motor first end comprises a contoured surface removably coupled to said motor first end.

3. The assembly of claim 2, wherein said contoured surface is hemispherical.

4. The assembly of claim 2, wherein said contoured surface is ogival.

5. The assembly of claim 2, wherein said contoured surface is elliptical.

6. A motor assembly comprising:

a fan housing comprising an air inlet and an air outlet;

a motor positioned within said air inlet, said motor comprising a first end, a second end, and a shaft;

a fan coupled to said shaft; and at least one mounting arm coupled to said motor and said fan housing, wherein said at least one mounting arm comprises a streamlined body having a pair of opposing surfaces that define one of an airfoil shape and an elliptical shape, said streamlined body further comprising a first end having a stagnation point, a second end, and a plurality of points along said pair of surfaces downstream of said stagnation point, said pair of surfaces extending from said first end and meeting at said second end;

wherein each point of the plurality of points has a coefficient of pressure less than 0.5, said streamlined body configured to direct air around said at least one mounting arm and to reduce airflow restriction and flow disturbance within said fan housing;

and wherein said at least one mounting arm is curved in the axial direction and is configured to turn airflow upstream of said fan.

7. The assembly of claim 6, wherein said streamlined body is a contoured cap removably coupled to said mounting arm.

8. The assembly of claim 6, further comprising an inlet guide vane positioned at least partially within said air inlet and coupled to said at least one mounting arm between said fan housing and said motor, wherein said guide vane comprises a curved inner surface opposite a curved outer surface, and wherein said curved inner surface and said curved outer surface are configured to direct air into said air inlet.

9. A motor assembly comprising:

a fan housing comprising an air inlet and an air outlet;

a motor positioned within said air inlet, said motor comprising a first end, a second end, and a shaft;

a fan coupled to said shaft proximate said motor second end; and at least one mounting arm coupled to said motor and said fan housing, wherein said at least one mounting arm comprises a streamlined body having a pair of opposing surfaces that define one of an airfoil shape and an elliptical shape, said streamlined body further comprising a first end having a first stagnation point, a second end, and a first plurality of points along a surface of said-streamlined body said pair of surfaces downstream of said first stagnation point, said pair of surfaces extending from said first end and meeting at said second end, wherein each point of the first plurality of points has a coefficient of pressure less than 0.5, said streamlined body configured to direct air around said at least one mounting arm, wherein said motor first end comprises a contoured surface having a second stagnation point and a second plurality of points along said contoured surface downstream of said second stagnation point, wherein each point of said second plurality of points has a coefficient of pressure less than 0.5, said contoured surface configured to direct air around said motor, and said streamlined body and said contoured surface configured to reduce airflow restriction and flow disturbance within said fan housing;

and wherein said at least one mounting arm is curved in the axial direction and is configured to turn airflow upstream of said fan.

10. The motor assembly of claim 9, wherein at least one of said streamlined body and said contoured surface is a removably coupled contoured cap.

11. The motor assembly of claim 9, wherein said contoured surface is elliptical.

12. The motor assembly of claim 9, wherein said contoured surface is one of hemispherical and ogival.

13. The assembly of claim 9, further comprising an inlet guide vane positioned at least partially within said air inlet and coupled to said at least one mounting arm between said fan housing and said motor, wherein said guide vane comprises a inner surface opposite a curved outer surface, and wherein said curved inner surface and said curved outer surface are configured to direct air into said air inlet.

14. A method of assembling a motor assembly, the method comprising:

providing a fan housing having an air inlet and an air outlet;

positioning a motor within the air inlet, the motor having a first end, a second end, a shaft, and at least one mounting arm;

coupling the at least one mounting arm to the fan housing;

coupling a fan to the shaft proximate the motor second end;

providing a streamlined body on the mounting arm, the streamlined body having a pair of opposing surfaces that define one of an airfoil shape and an elliptical shape, the streamlined body further including a first end having a first stagnation point, a second end, and a first plurality of points along the pair of surfaces downstream of the first stagnation point, wherein each point of the first plurality of points has a coefficient of pressure less than 0.5, wherein the pair of surfaces extend from the first end and meet at the second end, the streamlined body configured to direct air around the at least one mounting arm and to reduce airflow restriction and flow disturbance within the fan housing, said at least one mounting arm is curved in the axial direction and is configured to turn airflow upstream of said fan; and providing a contoured surface on the motor first end, the contoured surface having a second stagnation point and a second plurality of points along the contoured surface downstream of the second stagnation point, wherein each point of the second plurality of points has a coefficient of pressure less than 0.5, the contoured surface configured to direct air around the motor to reduce airflow restriction and flow disturbance within the fan housing.

15. The method of claim 14, further comprising coupling an inlet guide vane to the at least one mounting arm between the fan housing and the motor and positioned at least partially within the air inlet, wherein the guide vane comprises a curved inner surface opposite a curved outer surface, and wherein the curved inner surface and the curved outer surface are configured to direct air into the air inlet.

* * * * *